US005375703A

United States Patent [19]

Deuber

[11] Patent Number: 5,375,703

[45] Date of Patent: Dec. 27, 1994

[54] APPARATUS FOR RECYCLING LIQUIDS

[76] Inventor: Michael L. Deuber, 4104 Stone Pl., New Albany, Ind. 47150

[21] Appl. No.: 97,669

[22] Filed: Jul. 27, 1993

[51] Int. Cl.[5] ..... B65D 69/00; B65D 90/04

[52] U.S. Cl. ..... 206/223; 220/573; 220/404; 141/98

[58] Field of Search ..... 141/98, 325, 326; 220/573, 403, 404; 206/223

[56] References Cited

U.S. PATENT DOCUMENTS

| | | | |
|---|---|---|---|
| 4,533,042 | 8/1985 | Pollacco | 206/223 |
| 5,080,149 | 1/1992 | Peoples | 141/337 |
| 5,082,035 | 1/1992 | Maxwell | 141/98 |
| 5,092,457 | 3/1992 | Islava et al. | 206/223 |
| 5,154,308 | 10/1992 | Larson | 220/403 |

*Primary Examiner*—William I. Price
*Attorney, Agent, or Firm*—Middleton & Reutlinger

[57] ABSTRACT

An apparatus for recycling liquids, such as, for example, used motor oil. For example, an outer container, such as a five gallon plastic container, is provided which contains unused oil. A pump can be used to pump out the unused oil for use. This leaves a liquid void in the container. A collapsible bag is contained within the container and has an external opening. Used oil may then be poured into the collapsible bag replacing the liquid void left when the unused oil was pumped out, but not contaminating the unused oil. When all of the unused oil has been pumped out, the contained with the bag of used oil can be recycled. Alternatively, other liquids can be recycled. Also, the collapsible bag can contain the unused oil.

18 Claims, 2 Drawing Sheets

APPARATUS FOR RECYCLING LIQUIDS

BACKGROUND 0F THE INVENTION (a) Field the Invention

The present invention relates to an apparatus for recycling liquids, such as, for example, used motor oil. For example, an outer container contains unused oil, which can be pumped out leaving a liquid void in the container. A collapsible bag having an external opening is contained within the container and used oil may then be poured into the collapsible bag replacing the liquid void left when the unused oil was pumped out, but not contaminating the unused oil. When all of the unused oil has been pumped out, the container with the bag of used oil can be recycled.

(b) Description of the Prior Art

I am aware of the following references which teach somewhat related apparatuses. U.S. Pat. No. 5,080,149, to Peoples, teaches a collapsible and disposable container for engine oil in which the same container is used for unused and used oil. U.S. Pat. No. 5,082,035, to Maxwell, teaches an oil collecting and dispensing apparatus. A funnel receives used oil. The container is then recycled. U.S. Pat. No. 4,533,042, to Pollacco, teaches a motor oil change kit and catch pan. U.S. Pat. No. 5,092,457, to Islava et al., teaches an engine oil change kit.

SUMMARY OF THE INVENTION

The present invention is for an apparatus for recycling liquids, such as, for example, used motor oil. For example, an outer container, such as a five gallon plastic container, is provided which contains unused oil. A pump can be used to pump out the unused oil for use. This leaves a liquid void in the container. A collapsible bag is contained within the container and has an external opening. Used oil may then be poured into the collapsible bag replacing the liquid void left when the unused oil was pumped out, but not contaminating the unused oil. When all of the unused oil has been pumped out, the contained with the bag of used oil can be recycled. Alternatively, other liquids can be recycled. Also, the collapsible bag can contain the unused oil.

In particular, the present invention comprises an apparatus for recycling liquids having a first container having at least one external opening thereinto; a second container being contained within said first container and having an external opening thereinto; and, means for removing a liquid from the first container.

More particularly, the present invention comprises an apparatus for recycling liquids, having a first container having a first external opening thereinto and a second external opening thereinto, the second opening being a vent opening, wherein the first external opening thereinto the first container includes first means for sealing and wherein the second external opening thereinto the first container includes second means for sealing; a second container being contained within the first container, the second container having an external opening thereinto, wherein the external opening thereinto the second container includes third means for sealing; and, a removable pump assembly for removing a liquid from the first container, the removable pump assembly being insertable into the first external opening thereinto the first container and securable therein.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 6:
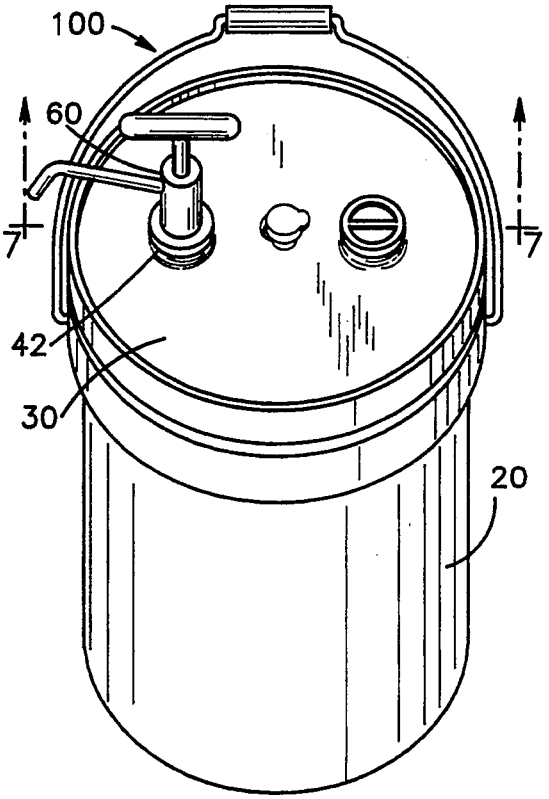
FIG. 6 shows a perspective view of an alternative embodiment of the present invention, wherein the pump has been inserted into the collapsible bag; and, FIG. 7 shows a cross-sectional view of the apparatus of FIG. 6.
Figure 7:
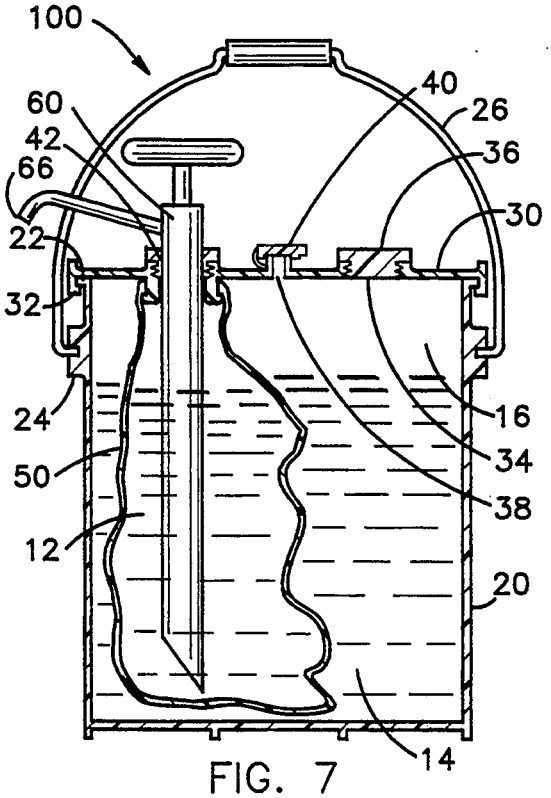

With reference to the figures, FIGS. 1–5 show the preferred embodiment for an apparatus 10 for recycling a liquid. FIGS. 6–7 show an alternative embodiment for an apparatus 100 for recycling a liquid. The only difference in the two embodiments is that in the preferred embodiment of FIGS. 1–5, a first fluid 12, for example, unused motor oil, is contained in a first container 15 and a second fluid 14, for example, used motor oil, is contained in a second container, seen as collapsible bag 50; while, in the alternative embodiment of FIGS. 6–7, the first fluid 12 is contained in the collapsible bag 50 and the second fluid 14 is contained in the first container 15.

While the apparatus of the present invention can be used to recycle any liquid, by using a proper container for the liquid type, the apparatus of the preferred embodiment of the present invention is described with relation to oil. Additionally, the apparatus of the present invention can be made available in many sizes, shapes, and materials; however, for the preferred embodiment, the apparatus is explained with respect to a five gallon container of motor oil. It is noted that, typically, changing oil in a motor vehicle requires about five quarts of oil and is recommended every 3 months. Therefore, for one vehicle, a five gallon container of unused oil would hold enough oil for four oil changes to occur over one year. Naturally, for larger operations, larger containers can be offered, e.g. 55 gallon drums. After four oil changes, the five gallon container, now containing the used oil can be recycled. It is felt that the apparatus of the present invention will make recycling of oil much easier and more appealing and, in addition, will replace twenty plastic quart containers, which are usually placed in the garbage and wind up in a land fill (often times containing used oil), with a five gallon container which can itself also be recycled.

Figure 1:
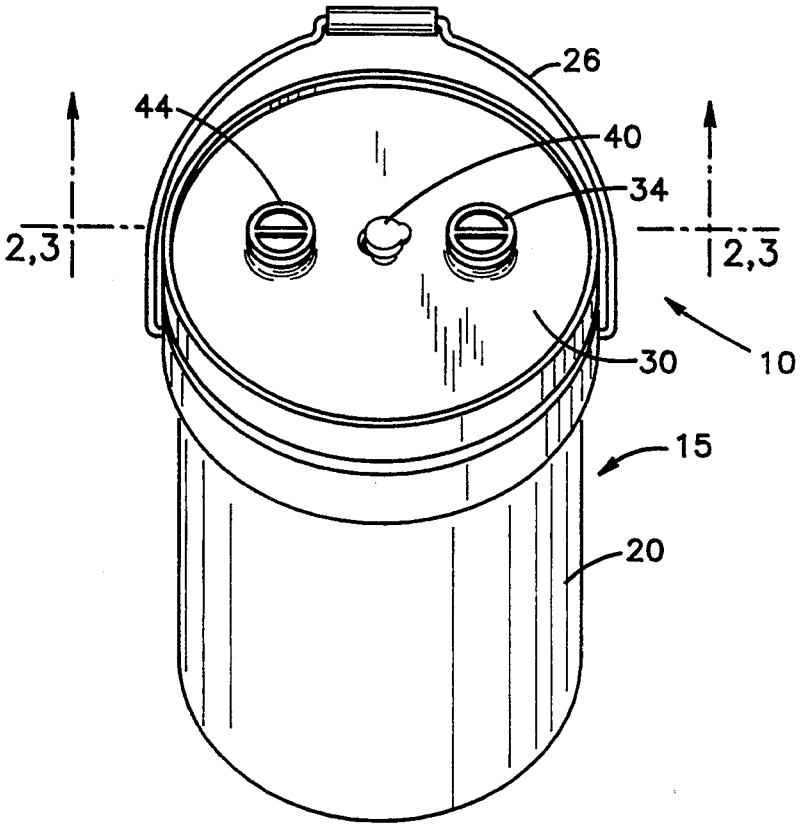
FIG. 1 shows a perspective view of the preferred embodiment for an apparatus for recycling liquids.
Figure 2:
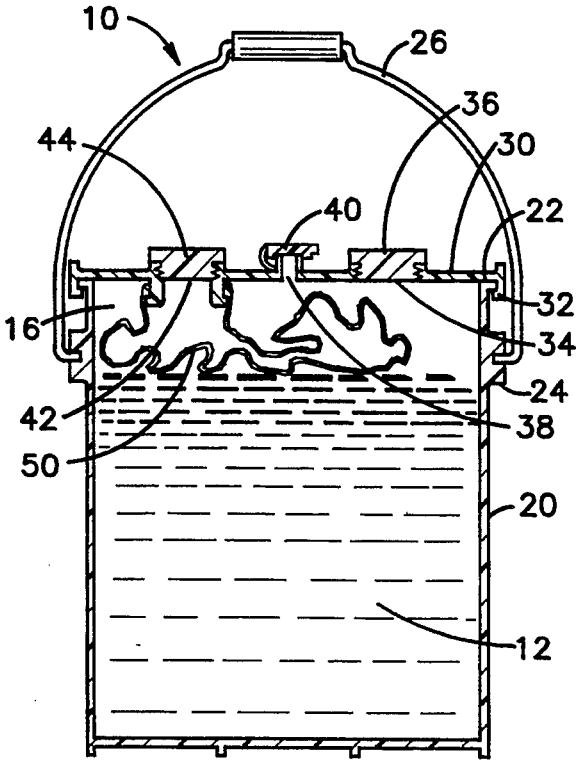
FIG. 2 shows a cross-sectional view of the apparatus of FIG. 1, as the apparatus would initially be purchased by a consumer.

With reference to FIGS. 1 and 2, the apparatus 10 of the preferred embodiment is shown. This is the apparatus 10 as it would be purchased by the consumer. The apparatus 10 is shown having a first container 15 with a second container, or collapsible bag 50, therein. FIG. 2 shows that, as purchased, the first container 15 contains the first fluid 12, unused motor oil, therein and that the bag 50 is empty. First container 15 is not completely full, containing a liquid void 16 thereatop first fluid 12.

First container 15 is shown comprising a bucket 20 and a lid 30. For example, a five gallon rigid plastic bucket and lid, such as one manufactured by Letica Corporation of Rochester, Mich., can be utilized. Bucket 20 has a lip 22 therearound. Bucket has a handle receiving portion 24 which receives a handle 26. Lid 30 has a catch 32 therearound which engages lip 22 to secure bucket 20 and lid 30.

Lid 30 is shown having a first opening 34 having a removable plug 36 therein; a second, or vent, opening 38 having a removable cap 40 thereon; and, a third opening 42 having a removable plug 44 therein. Opening 42 provides input to collapsible bag 50. For use in disposing of used motor oil, bag 50 should be of construction to securely retain used motor oil of about one hundred fifty degrees Fahrenheit, without leaking. For example, a poly-vinyl bag can be employed, such as bag model number 5MPOCDWEBEC manufactured by Liqui-Box Corporation of Ashland, Ohio.

Figure 3:
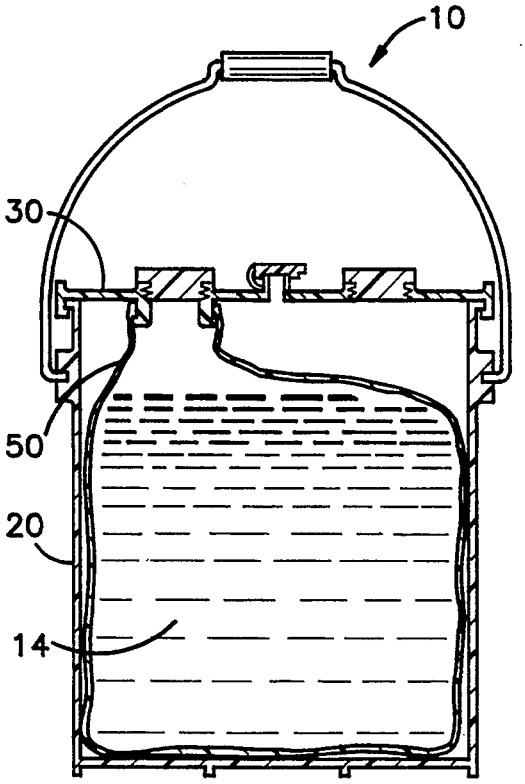
FIG. 3 shows a cross-sectional view of the apparatus of FIG. 1, after use by the consumer, the apparatus being ready for recycling.

FIG. 3 shows apparatus 10 after the first liquid 12 has been removed from bucket 20 and the second liquid 14 has been inserted into bag 50. Plugs 36 and 44 and cap 40 are in place, thereby sealing any liquids 12 or 14 into apparatus 10 and making apparatus 10 secured for recycling.

Figure 4:
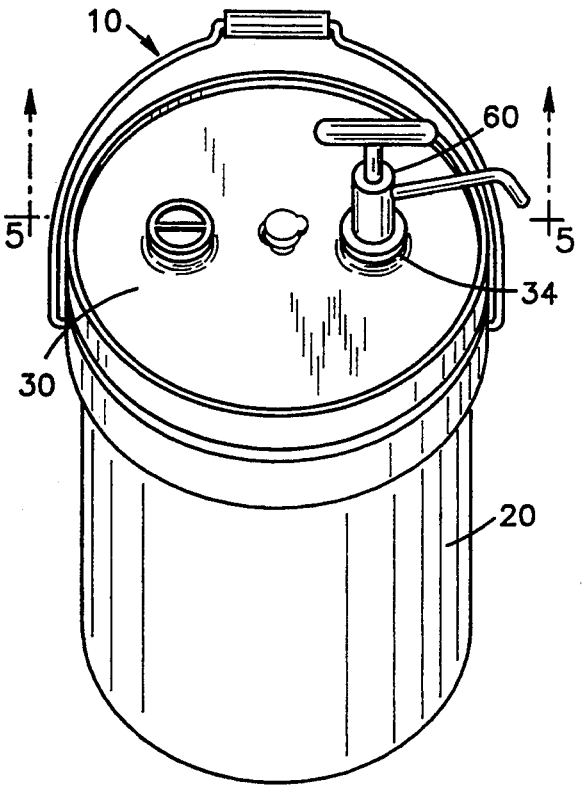
FIG. 4 shows a perspective view of the apparatus of FIG. 1 with a pump inserted for removing a liquid.
Figure 5:
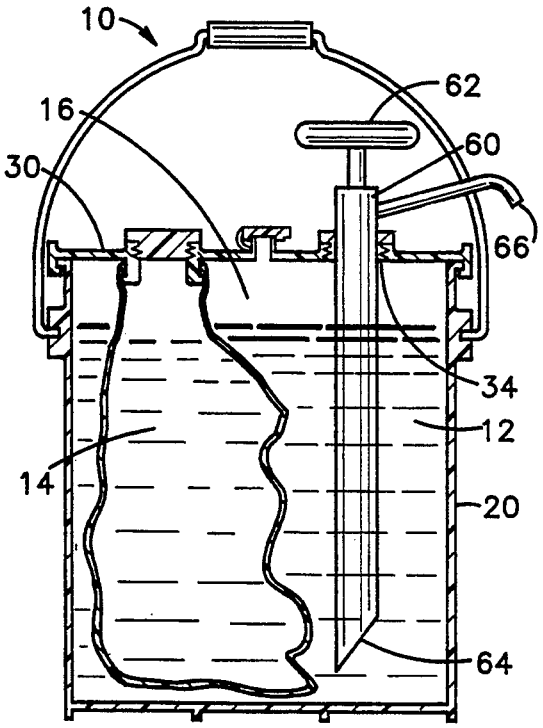
FIG. 5 shows a cross-sectional view of the apparatus of FIG. 4, wherein some liquid has been pumped from the rigid outer container and wherein some liquid has been inserted into the collapsible bag.

FIGS. 4 and 5 show the apparatus 10 embodiment of FIGS. 1–5 as it would be used by the consumer to remove unused oil 12 through pump assembly 60 and to insert used oil 14 into bag 50. Pump assembly 60 functions as a means for removing liquid 12 from the first container 15 and is shown having a pump handle 62, a liquid intake 64, and a liquid outlet 66. For a five gallon container, pump 60 can dispense between one ounce and, preferably, four ounces each time pump handle 62 is activated by, for example, pressing it downward toward lid 30. Pump assembly 60 can be of metal or plastic construction, for example. For example, Multi-Meter Corporation of Auburn, Ind. manufactures a suitable four ounce pump. Pump assembly 60 can be used over and over again. Therefore, apparatus 10 can be marketed with and/or without pump apparatus 60. Also, pump assembly 60 can be marketed separately from apparatus 10.

It is envisioned that, within the scope of this invention, other means for removing a liquid can be employed. For example, as with box wine and insulated water coolers, a user operable spigot can be placed toward the bottom of bucket 20, which the user can activate to pour unused motor oil 12 from bucket 20. The spigot configuration could be desirable, for example, if a 55 gallon drum was employed.

With reference to FIGS. 6 and 7, an alternative embodiment to the preferred embodiment of FIGS. 1–5 is shown. Apparatus 100 and apparatus 10 are similarly constructed, except the unused liquid 12 has been placed into bag 50 and the pump assembly 60, placed into opening 42, can be used to pump the liquid 12 therefrom. As bag 50 has liquid 12 pumped therefrom, its volume decreases, leaving a liquid void 16 in bucket 20. The used oil 14 can then be inserted into bucket 20 through opening 34 in lid 30, vent opening 38 easing this insertion. As with the preferred embodiment, when unused oil 12 has been used and used oil 14 inserted, plugs 36 and 44 and cap 40 can seal apparatus 100 and apparatus 100 can be recycled. Even further, a container having dual bags or compartments therein can be employed, one bag or compartment having unused oil, the other bag or compartment for receiving used oil. Means can be provided to remove the unused oil and insert the used oil.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An apparatus for recycling liquids, comprising:

a. a first container, said first container having an external opening thereinto;

b. a second container, said second container being contained within said first container, said second container having an external opening thereinto;

c. means for removing a liquid from said first container;

d. where said external opening thereinto said second container is an inlet for receiving a liquid to be recycled.

2. The apparatus of claim 1, wherein said external opening thereinto said first container includes first means for sealing said external opening thereinto and wherein said external opening thereinto said second container includes second means for sealing said external opening thereinto.

3. The apparatus of claim 1, wherein said first container is a rigid container.

4. The apparatus of claim 1, wherein said second container comprises a collapsible bag.

5. The apparatus of claim 1, wherein said means for removing a liquid from said first container comprises a pump assembly insertable into said external opening thereinto said first container, said pump assembly being securable therein.

6. An apparatus for recycling liquids, comprising:

a. a first container, where said first container is a rigid container, said first container having a first external opening thereinto and a second external opening thereinto, said second opening being a vent opening, where said first external opening thereinto said first container includes first means for sealing and where said second external opening thereinto said first container includes second means for sealing;

b. a second container, where said second container comprises a collapsible bag, said second container being contained within said first container, said second container having an external opening thereinto, where said external opening thereinto said second container includes third means for sealing;

c. a removable pump assembly for removing a liquid from said first container, said removable pump assembly being insertable into said first external opening thereinto said first container and securable therein;

d. where said first container comprises a bucket and a lid securable thereon, said lid including said first and said second external openings thereinto said first container and said external opening thereinto said second container.

7. The apparatus of claim 6, wherein said first container has a liquid capacity of five gallons.

8. The apparatus of claim 7, wherein said removable pump assembly has a pumping capacity of from 1–4 ounces.

9. The apparatus of claim 6, further comprising means for inserting a liquid to be recycled into said external opening thereinto said second container.

10. An apparatus for recycling liquids, comprising:

a. a first container, said first container having an external opening thereinto;

b. a second container, said second container being contained within said first container, said second container having an external opening thereinto;

c. means for removing a liquid from said second container;

d. where said external opening thereinto said first container is an inlet for receiving a liquid to be recycled.

11. The apparatus of claim 10, wherein said external opening thereinto said first container includes first means for sealing said external opening thereinto and wherein said external opening thereinto said second container includes second means for sealing said external opening thereinto.

12. The apparatus of claim 10, wherein said first container is a rigid container.

13. The apparatus of claim 10, wherein said second container comprises a collapsible bag.

14. The apparatus of claim 10, wherein said means for removing a liquid from said second container comprises a pump assembly insertable into said external opening thereinto second container and securable therein.

15. The apparatus of claim 5, wherein said first container has a liquid capacity of five gallons.

16. The apparatus of claim 5, wherein said pump assembly has a pumping capacity of from 1–4 ounces.

17. The apparatus of claim 14, wherein said first container has a liquid capacity of five gallons.

18. The apparatus of claim 14, wherein said removable pump assembly has a pumping capacity of from 1–4 ounces.

* * * * *

UNITED STATES PATENT AND TRADEMARK OFFICE

CERTIFICATE OF CORRECTION

PATENT NO. : 5,375,703

DATED : Dec. 27, 1994

INVENTOR(S) : Michael L. Deuber

It is certified that error appears in the above-indentified patent and that said Letters Patent is hereby corrected as shown below:

In Column 6, Line 10, after thereinto and before second insert --said--.

Signed and Sealed this

Twenty-third Day of April, 1996

Bruce Lehman

*Attest:*

BRUCE LEHMAN

*Attesting Officer*

*Commissioner of Patents and Trademarks*